US005771522A

United States Patent [19]

Carmody

[11] Patent Number: 5,771,522

[45] Date of Patent: Jun. 30, 1998

[54] DENTAL HYGIENE WIPE

[76] Inventor: Shawn J. Carmody, 27 Manor Rd., Phillipsburg, N.J. 08865

[21] Appl. No.: 732,696

[22] Filed: Oct. 18, 1996

[51] Int. Cl.[6] ..... A47K 7/02

[52] U.S. Cl. ..... 15/208; 15/104.93; 15/209.1; 15/210.1; 15/229.11; 428/156; 451/539

[58] Field of Search ..... 15/104.93, 118, 15/208, 209.1, 210.1, 229.11, 244.3; 451/526, 527, 530, 539; 428/156

[56] References Cited

U.S. PATENT DOCUMENTS

| | | | |
|---|---|---|---|
| 3,639,199 | 2/1972 | Brandts et al. | 15/209.1 X |
| 3,857,133 | 12/1974 | Linenfelser | 15/244.3 X |
| 4,111,666 | 9/1978 | Kalbow | 15/118 X |
| 4,335,731 | 6/1982 | Bora, Jr. | 15/104.93 X |
| 4,831,676 | 5/1989 | Denmark | 15/104.93 |
| 5,126,137 | 6/1992 | Lambert | 15/244.3 X |

FOREIGN PATENT DOCUMENTS

| | | | |
|---|---|---|---|
| 263144 | 2/1964 | Australia | 15/104.93 |
| 728847 | 3/1966 | Canada | 15/118 |

*Primary Examiner*—Mark Spisich

[57] ABSTRACT

A dental hygiene wipe for cleaning exterior surfaces and interproximal areas of teeth. The inventive device includes a flexible base substrate having an abrasive cleaning pad coupled to the base substrate. The abrasive cleaning pad includes a plurality of quarter-spherical projections which can be used to effect cleaning and polishing of tooth enamel. The abrasive cleaning pad is preferably comprised of a porous material which can be impregnated with a dentifrice, mouth wash, or other moist substance.

6 Claims, 2 Drawing Sheets

DENTAL HYGIENE WIPE

BACKGROUND OF THE INVENTION

1. Field of the Invention

The present invention relates to dental cleaning implements and more particularly pertains to a dental hygiene wipe for cleaning exterior surfaces and interproximal areas of teeth.

2. Description of the Prior Art

The use of dental cleaning implements is known in the prior art. More specifically, dental cleaning implements heretofore devised and utilized are known to consist basically of familiar, expected and obvious structural configurations, notwithstanding the myriad of designs encompassed by the crowded prior art which have been developed for the fulfillment of countless objectives and requirements.

Known prior art dental cleaning implements include U.S. Pat. No. 4,617,694; U.S. Pat. No. 5,107,562; U.S. Pat. No. 5,068,941; U.S. Pat. No. 323,305; U.S. Pat. No. 2,419,896; U.S. Pat. No. 3,141,366; U.S. Pat. No. 3,905,113; U.S. Pat. No. 3,368,668; U.S. Pat. No. 3,298,507; U.S. Pat. No. 2,966,691; U.S. Pat. No. 4,879,442; U.S. Pat. No. 3,934,299; U.S. Pat. No. 2,068,400; U.S. Pat. No. 2,099,305; U.S. Pat. No. 4,972,946; and U.S. Pat. No. 2,092,987.

While these devices fulfill their respective, particular objectives and requirements, the aforementioned patents do not disclose a dental hygiene wipe for cleaning exterior surfaces and interproximal areas of teeth which includes a flexible base substrate having an abrasive cleaning pad coupled to the base substrate and including a plurality of quarter-spherical projections which can be used to effect cleaning and polishing of tooth enamel, with the abrasive cleaning pad being comprised of a porous material which can be impregnated with a dentifrice, mouth wash, or other moist substance.

In these respects, the dental hygiene wipe according to the present invention substantially departs from the conventional concepts and designs of the prior art, and in so doing provides an apparatus primarily developed for the purpose of cleaning exterior surfaces and interproximal areas of teeth.

SUMMARY OF THE INVENTION

In view of the foregoing disadvantages inherent in the known types of dental cleaning implements now present in the prior art, the present invention provides a new dental hygiene wipe construction wherein the same can be utilized for cleaning exterior surfaces and interproximal areas of teeth. As such, the general purpose of the present invention, which will be described subsequently in greater detail, is to provide a new dental hygiene wipe apparatus and method which has many of the advantages of the dental cleaning implements mentioned heretofore and many novel features that result in a dental hygiene wipe which is not anticipated, rendered obvious, suggested, or even implied by any of the prior art dental cleaning implements, either alone or in any combination thereof.

To attain this, the present invention generally comprises a dental hygiene wipe for cleaning exterior surfaces and interproximal areas of teeth. The inventive device includes a flexible base substrate having an abrasive cleaning pad coupled to the base substrate. The abrasive cleaning pad includes a plurality of quarter-spherical projections which can be used to effect cleaning and polishing of tooth enamel.

The abrasive cleaning pad is preferably comprised of a porous material which can be impregnated with a dentifrice, mouth wash, or other moist substance.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dental hygiene wipe apparatus and method which has many of the advantages of the dental cleaning implements mentioned heretofore and many novel features that result in a dental hygiene wipe which is not anticipated, rendered obvious, suggested, or even implied by any of the prior art dental cleaning implements, either alone or in any combination thereof.

It is another object of the present invention to provide a new dental hygiene wipe which may be easily and efficiently manufactured and marketed.

It is a further object of the present invention to provide a new dental hygiene wipe which is of a durable and reliable construction.

An even further object of the present invention is to provide a new dental hygiene wipe which is susceptible of a low cost of manufacture with regard to both materials and labor, and which accordingly is then susceptible of low prices of sale to the consuming public, thereby making such dental hygiene wipes economically available to the buying public.

Still yet another object of the present invention is to provide a new dental hygiene wipe which provides in the apparatuses and methods of the prior art some of the advantages thereof, while simultaneously overcoming some of the disadvantages normally associated therewith.

Still another object of the present invention is to provide a new dental hygiene wipe for cleaning exterior surfaces and interproximal areas of teeth.

Yet another object of the present invention is to provide a new dental hygiene wipe which includes a flexible base substrate having an abrasive cleaning pad coupled to the base substrate and including a plurality of quarter-spherical projections which can be used to effect cleaning and polishing of tooth enamel.

Even still another object of the present invention is to provide a new dental hygiene wipe wherein the abrasive cleaning pad being is comprised of a porous material which can be impregnated with a dentifrice, mouth wash, or other moist substance.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
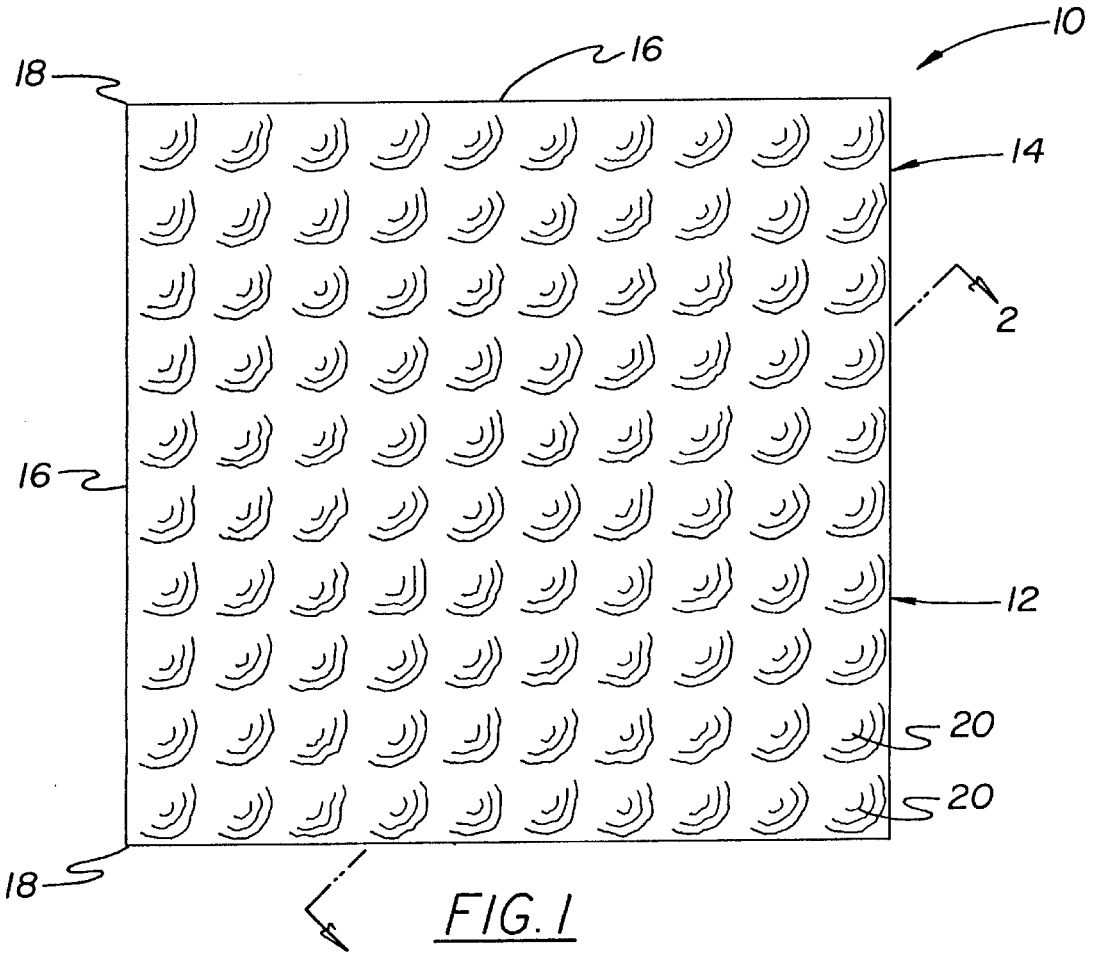
FIG. 1 is a top plan illustration of the preferred embodiment of the dental hygiene wipe constructed in accordance with the principles of the present invention.

With reference now to the drawings, and in particular to FIGS. 1–6 thereof, a new dental hygiene wipe embodying the principles and concepts of the present invention and generally designated by the reference numeral 10 will be described.

More specifically, it will be noted that the dental hygiene wipe 10 comprises a flexible base substrate 12 having an abrasive cleaning means 14 coextensively covering an upper surface of the flexible base substrate 12 for abrasively cleaning exterior surfaces and interproximal areas of human teeth. As shown in FIG. 1, the base substrate 12 and the correspondingly shaped abrasive cleaning means 14 are preferably shaped so as to define a plurality of intersecting linear edges 16 which cooperate to define corners 18 at intersections of the linear edges. The corners 18 can be orthogonal corners, as illustrated, so as to permit for each of the corners to be utilized as a pick. By this structure, the abrasive cleaning means 14 of the invention 10 can be wiped over exterior surfaces of human teeth to effect cleaning of food and debris therefrom. Further, one of the linear edges 16 can be interposed and oscillated between adjacent teeth to simulate the effects of flossing. Lastly, one of the corners 18 of the invention 10 can be slid along a juncture of two adjacent teeth to clean debris from this juncture.

Figure 2:
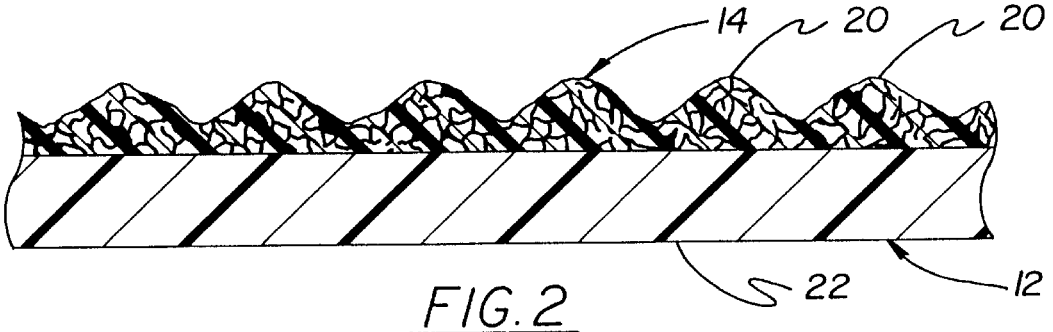
FIG. 2 is a cross sectional view of the present invention taken along line 2—2 of FIG. 1.
Figure 3:
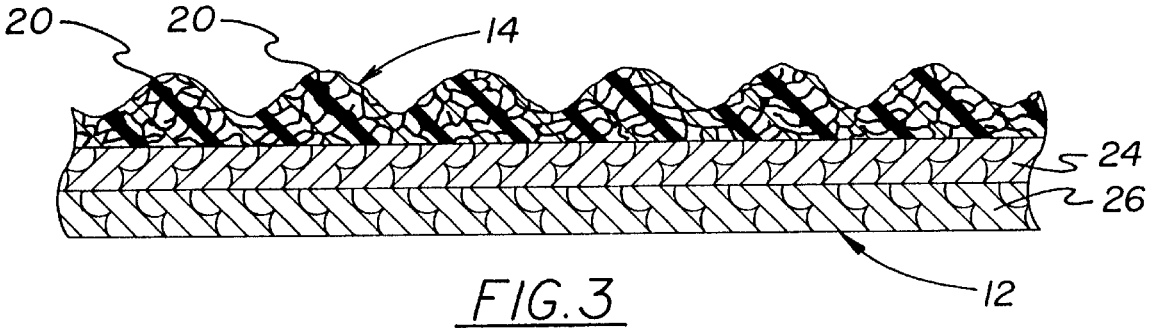
FIG. 3 is a cross sectional view of an alternative form of the invention.

Referring now to FIGS. 1 through 3 with particularity, it can be shown that the abrasive cleaning means 14 of the invention 10 preferably comprises a flexible layer of material bonded or otherwise secured to the base substrate 12 by an adhesive or the like. The flexible layer of material is shaped so as to define a plurality of raised quarter-spherical projections 20 extending in aligned rows and columns between the linear edges 16 of the flexible base substrate 12. The quarter-spherical projections 20 are each shaped so as to define an unlabeled semi-circular planar outer surface and an unlabeled quarter-spherical outer surface which cooperate to define the quarter-spherical shape of the projections. The semi-circular planar outer surface of each of the projections 20 is oriented so as to reside within a plane oriented orthogonally relative to a plane containing the base substrate. Further, the plane containing the semicircular planar outer surface of each of the projections 20 is oriented so as to intersect adjacent linear edges 16 of the base substrate. By this structure, the quarter-spherical projections 20 provide a first degree of abrasion when moved in a first direction wherein the semi-circular planar outer surface of each of the projections 20 leads the motion of the abrasive cleaning means 14 across a tooth, and a second degree of abrasion when moved in a second direction wherein the semicircular planar outer surface of each of the projections 20 follows the motion. The first degree of abrasion is substantially greater than the second degree of abrasion since the semi-circular planar outer surface will scrape the surface to a degree higher than the scraping provided by the quarterspherical outer surface. Further, the degree of abrasion provided by the semi-circular planar outer surface of each of the projections 20 is varied in relation to the angular orientation thereof relative to the direction of motion, whereas the degree of abrasion provided by the semi-spherical outer surface of each of the projections 20 is not varied. This allows an individual to orient the invention 10 as desired to obtain a particular degree of abrasion depending on the range of motion available for movement of the device 10 within a human mouth.

As shown in FIG. 2, the base substrate 12 may comprise a single layer of polymeric material 22 having the abrasive cleaning means adhesively or otherwise secured thereto. Alternatively, the base substrate 12 may comprise a first fiber substrate layer 24 secured to a second fiber substrate layer 26. The fiber substrate layers 24 and 26 preferably each include fibers oriented in a single direction, with the layers being orthogonally offset relative to one another such that the fibers within each layer are orthogonally offset to impart a slight rigidity to the base substrate. The fiber substrate layers 24 and 26 can comprise a paper or cardboard material and should be at least somewhat flexible to allow the invention to be curved to the exterior shape of a tooth.

Figure 4:
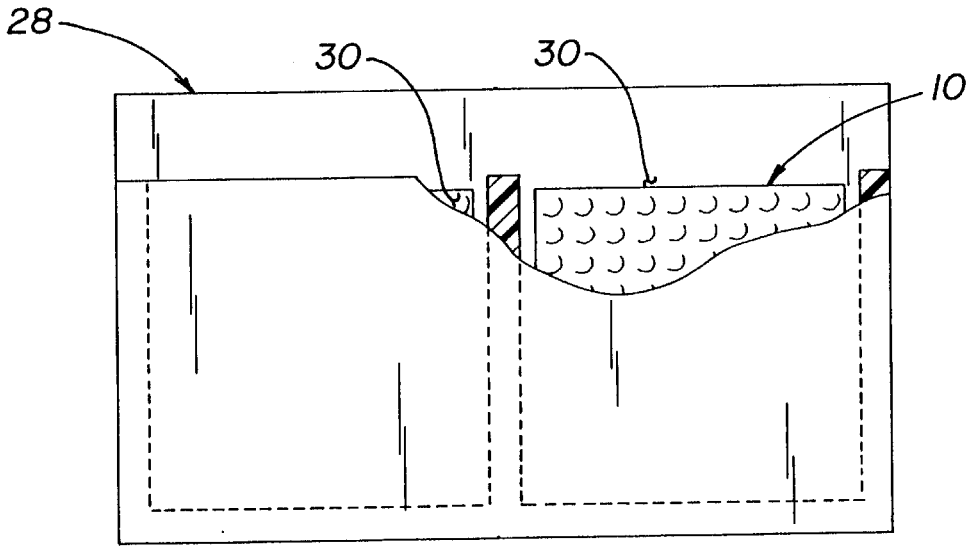
FIG. 4 is a front elevational view, partially in cross section, of the invention including an openable package.
Figure 5:
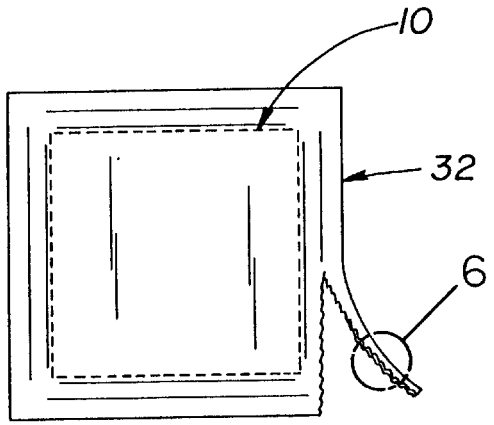
FIG. 5 is a front elevational view of the invention including a frangible package.
Figure 6:
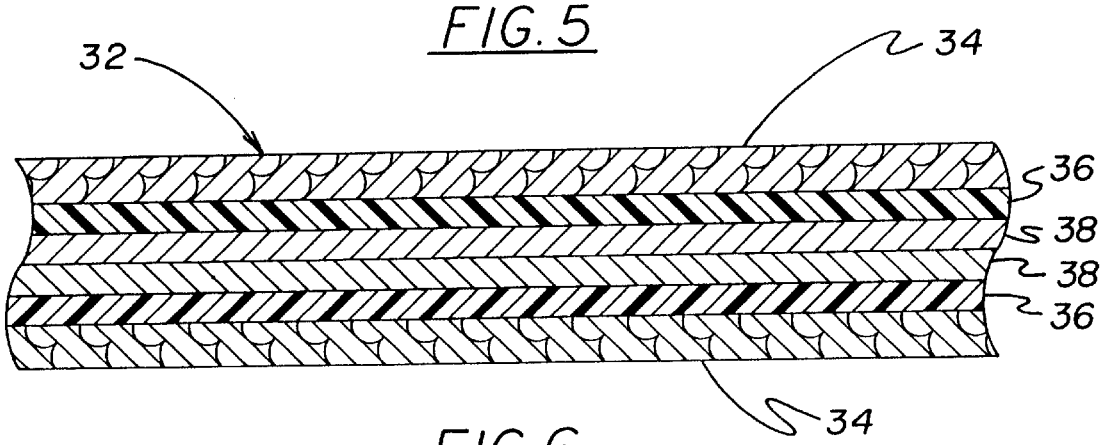
FIG. 6 is a cross sectional view of the area set forth in FIG. 5 of the frangible package.

Turning now to FIG. 4, it can be shown that the invention 10 may include an openable package 28 having one or more pockets 30 within which the invention 10 can be stored prior to use thereof. FIGS. 5 and 6 illustrate the invention 10 as including a frangible sealed package 32 which can be torn open prior to use. The sealed package 32 allows the abrasive cleaning means 14 to be impregnated with a dentifrice or mouth wash material or liquid and to maintain the invention 10 in a moist condition prior to use. As shown in FIG. 6, the frangible sealed package 32 is preferably formed of a plurality of layers including outer paper layers 34 suitable for displaying printed indicia, as well as inner polymeric and foil layers 36 and 38 which cooperate to retain moisture within the package 32.

In use, the dental hygiene wipe 10 of the present invention 10 can be easily utilized for cleaning exterior surfaces and interproximal areas of teeth. To this end, the device 10 can simply be wiped over the exterior surface of human or animal teeth. The linear edges 16 can be used for flossing and the orthogonal corners 18 can be utilized as a pick.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dental hygiene wipe comprising in combination:

a flexible base substrate;

an abrasive cleaning means coextensively covering an upper surface of the flexible base substrate for abrasively cleaning exterior surfaces and interproximal areas of human teeth, the base substrate and the abrasive cleaning means are shaped so as to define a plurality of intersecting linear edges which cooperate to define corners at intersections of the linear edges, the corners are orthogonal corners which can be utilized as a pick to clean along a juncture of two adjacent teeth to clean debris from the juncture;

the abrasive cleaning means having a flexible layer of material secured to the base substrate, the flexible layer of material being shaped so as to define a plurality of raised quarter-spherical projections extending therefrom, the quarter-spherical projections extend in aligned rows and columns between the linear edges of the flexible base substrate; and the quarter-spherical projections are each shaped so as to define a semi-circular planar outer surface and a quarter-spherical outer surface which cooperate to define a quarter-spherical shape of the projections, the semi-circular planar outer surface of each of the projections being oriented so as to reside within a plane oriented orthogonally relative to a plane containing the base substrate such that the quarter-spherical projections provide both a first degree of abrasion when moved in a first direction wherein the semi-circular planar outer surface of each of the projections leads motion of the abrasive cleaning means across a tooth, and a second degree of abrasion when moved in a second direction wherein the semi-circular planar outer surface of each of the projections follows the motion of the abrasive cleaning means across a tooth, wherein the first degree of abrasion is substantially greater than the second degree of abrasion.

2. The dental hygiene wipe of claim 1, wherein the base substrate comprises a single layer of polymeric material having the abrasive cleaning means secured thereto.

3. The dental hygiene wipe of claim 1, wherein the base substrate comprises a first fiber substrate layer; and a second fiber substrate layer secured to the first fiber substrate layer.

4. The dental hygiene wipe of claim 3, wherein the fiber substrate layers each include fibers oriented in a single direction, with the layers being orthogonally offset relative to one another such that the fibers within each layer are orthogonally offset to impart rigidity to the base substrate.

5. The dental hygiene wipe of claim 4, and further comprising a package having at least one pocket within which the base substrate and the abrasive cleaning means are positioned.

6. The dental hygiene wipe of claim 5, wherein the package comprises a frangible sealed package.

* * * * *